US005860834A

United States Patent [19]

Sugiyama

[11] Patent Number: 5,860,834

[45] **Date of Patent: *Jan. 19, 1999**

[54] DOUBLE-LOCK-TYPE CONNECTOR

[75] Inventor: Osamu Sugiyama, Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 703,770

[22] Filed: Aug. 27, 1996

[30] Foreign Application Priority Data

Aug. 29, 1995 [JP] Japan ..... 7-220275

[51] Int. Cl.[6] ..... H01R 13/436

[52] U.S. Cl. ..... 439/595; 439/752

[58] Field of Search ..... 439/752, 595, 439/689, 687, 685

[56] References Cited

U.S. PATENT DOCUMENTS

| | | | |
|---|---|---|---|
| 4,921,437 | 5/1990 | Cooper et al. | 439/595 |
| 4,959,023 | 9/1990 | Watanabe et al. | 439/595 |
| 5,085,599 | 2/1992 | Maejima et al. | 439/752 |
| 5,120,269 | 6/1992 | Endo et al. | 439/752 |
| 5,529,515 | 6/1996 | Ohtaka et al. | 439/595 |
| 5,738,542 | 4/1998 | Jakobeit et al. | 439/595 |

FOREIGN PATENT DOCUMENTS

| | | |
|---|---|---|
| 61-153975 | 9/1986 | Japan . |
| 64-34770 | 3/1989 | Japan . |
| 7-57809 | 3/1995 | Japan . |

*Primary Examiner*—Gary F. Paumen

*Attorney, Agent, or Firm*—Armstrong, Westerman, Hattori, McLeland & Naughton

[57] ABSTRACT

A double-lock-type connector includes a female connector housing body 2 having a terminal insertion section 20 into which a male terminal is inserted, and a terminal receiving chamber 5 which can receive a female terminal 9 engaged with the male terminal, a resilient locking piece 10 projected on the terminal receiving chamber 5 for locking the female terminal 9, a rear holder 3 removably provided for the female connector housing body 2 for avoiding movement rearward of the female terminal 9 locked on the inside of the terminal receiving chamber 5 by the resilient locking piece 10, a housing side tapered guide portion 6 and a rear holder side tapered guide portion 7 for guiding the male terminal toward the terminal insertion portion 20, wherein by causing the rear holder 3 to mount on the female connector housing body 2 an integral tapered guide portion 8 is formed at whole periphery of the terminal insertion portion 20.

8 Claims, 5 Drawing Sheets

DOUBLE-LOCK-TYPE CONNECTOR

BACKGROUND OF THE INVENTION

1. Field of the Invention

The present invention relates to a multi-pole connector which is employed for the purpose of making connections of the wire harness for the internal wiring of the automobiles.

2. Description of the Prior Art

A wire harness employed for the purpose of making connections for the internal wiring of automobiles increases with the increase of electric appliance in automobiles. Connectors employed for the purpose of making connections for the wire harnesses tend to be multi-polarized accordingly. As shown in FIGS. 5 and 6, the Japanese Utility Model Application Laid Open No. 61-153975 discloses such multi-pole connector.

The connector in which the terminals can be double-locked, has a housing 140 made of insulating material for receiving a plurality of male terminals 141 arranged in a row, and holding the male terminals 141. A motion toward a direction of one axis of the plurality of male terminals 141 is prevented by the shoulder 142 in the housing 140.

The male terminals 141 are prevented from moving backward by a movable prong 145 band-connected to the housing 140. The movable prong 145 is movable between an open-position where the male terminals 141 can be inserted into or pulled out from the housing 140 and a close-position where the electric contacts are so pressed toward the shoulder 142 at where a part of the movable prong 145 engages with the male terminals 141.

A band 147 of the movable prong 145 is arranged on both side-ends of the male terminals 141. A plurality of engaging shoulders 146 for the male terminals are provided at the movable prong 145 and an opening 149 into which the plurality of engaging shoulders 146 for the male terminals are inserted is provided at the housing 140. The plurality of engaging shoulders 146 for the male terminals and the opening 149 are provided correspondingly to the male terminals 141. An engaging portion 148 in which, when the movable prong 145 is positioned at the open-position, the plurality of engaging shoulders 146 for the male terminals leave from the male terminals 141 and while, when the movable prong 145 is positioned at the close-position, the movable prong 145 engages with the male terminals 141 so as to be held the closed state. The engaging portion 148 is provided at the plurality of engaging shoulders 146 for the male terminals and at the housing 140. Furthermore, a tapered guide portion 150 of the male metallic terminal is formed in front of the housing 140 for easy insertion of the male terminal.

On the other hand, a connector shown in FIGS. 7 and 8 has been disclosed in the Japanese Utility Model Laid Open No. 64-34770. A plurality of terminal receiving chambers 232 are elongated in the longitudinal direction of a rectangular parallelpiped-housing 231 which is made of synthetic resin. An opening which arrives at each of the terminal receiving chamber 232 is formed backward at the base of the housing 231. Terminals 234 are inserted into each of the terminal receiving chamber 232 from the rear so as to be received.

The opening is so filled that a locking nail 239 of each terminal 234 engages with a lance 233 on the inside of the terminal receiving chamber 232, with the result that a second locking portion 238 can be removably mounted on the housing 231. The rear of a protuberance 251 of the terminal 234 is engaged with the front face of the second locking portion 238 so as to be locked the terminal 234. The resilient engaging portion 241 which is bendable from one side to the other at the lower part on both side surfaces of right and left of the housing 231, is integrally formed. Each locking nail 239 projected integrally on both sides of right and left of the second locking portion 238 is engaged respectively with these resilient engaging portions 241. Both ends of U-shaped band are joined integrally with the base of the resilient engaging portion 241 and the both end portions of right and left of the second locking portion 238.

However, in the above former first example, the tapered guide portion can not be formed at the position where the engaging shoulder for the male terminal is placed because the engaging shoulder for the male terminal is an encumbrance to the mold release thereof. When the width of the engaging shoulder portion of the female connector is approximated by the width of the tab of the male metallic terminal caused by the miniaturization of the connector, the male terminal can enter into the portion where the tapered guide portion of the female connector is not in existence, with the result that the front end portion of the female terminal is pierced with the male terminal. For this reason, omission of the terminal or bad conduction occurred.

Thereby, in the above latter second example, the tapered guide portion is so constituted that it is provided at whole periphery of the opening by shifting position of the lance. However there are problems that the external diameter of the connector becomes large and the height of the female terminal box becomes high because of shifting of the lance. Additionally, since the thickness of the tapered guide portion is thin because of shifting of the lance, when the male terminal is inserted into the female terminal box, the male terminal may pierce through the tapered guide portion.

SUMMARY OF THE INVENTION

In view of the foregoing, it is an object of the present invention to provide a double-lock type connector in which the size is miniaturized and guiding of the male terminal toward the terminal insertion portion of the female terminal is capable of being achieved smoothly.

It is another object of the present invention to provide a double-lock type connector in which it causes the number of parts to decrease and causes the assembling operation to facilitate.

According to one aspect of the present invention, for achieving the above-mentioned objects, there is provided a double-lock type connector which comprises a female connector housing body having a terminal insertion portion which can receive a male terminal in front thereof and having a terminal receiving chamber which can receive a female terminal engaged with the male terminal, a resilient locking piece which is projected on an inside wall of the terminal receiving chamber for locking the female terminal, a rear holder which is removably provided for the female connector housing for avoiding movement rearward of the female terminal locked on the inside of the terminal receiving chamber by the resilient locking piece, a housing side guiding-tapered portion formed at the female connector housing body for guiding the male terminal toward the terminal insertion portion, and a rear holder side guide-tapered portion formed at the rear holder for guiding the male terminal toward the terminal insertion portion, wherein by causing the rear holder to mount on the female connector housing body an integral guide-tapered portion is formed at whole periphery of the terminal insertion portion consisting both of the housing side guide-tapered portion and the rear holder side guide-tapered portion.

Preferably, the rear holder is integrally formed with the female connector housing body through a hinge.

As stated above, since the double-lock type connector according to the present invention is provided with the housing side guide-tapered portion and the rear holder side guide-tapered portion, the integral guide-tapered portion at all over the periphery of the male terminal insertion portion is capable of being formed.

Further, since the double-lock connector is so formed that the rear holder is integrally formed with the female connector housing body through a hinge, number of the parts are decreased and assembling operation of the connector is facilitated.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

BRIEF DESCRIPTION OF THE DRAWINGS

FIGS. 4A and 4B are cross sectional views along the line 4—4 of FIG. 2 which are explanation views showing the process for double-locking the terminal to the double-lock type connector, wherein FIG. 4A shows the condition causing the terminal to lock by the resilient locking piece, and FIG. 4B shows the condition causing the terminal to lock doubly by the rear holder;

DETAILED DESCRIPTION OF THE PREFERRED EMBODIMENTS

Figure 1:
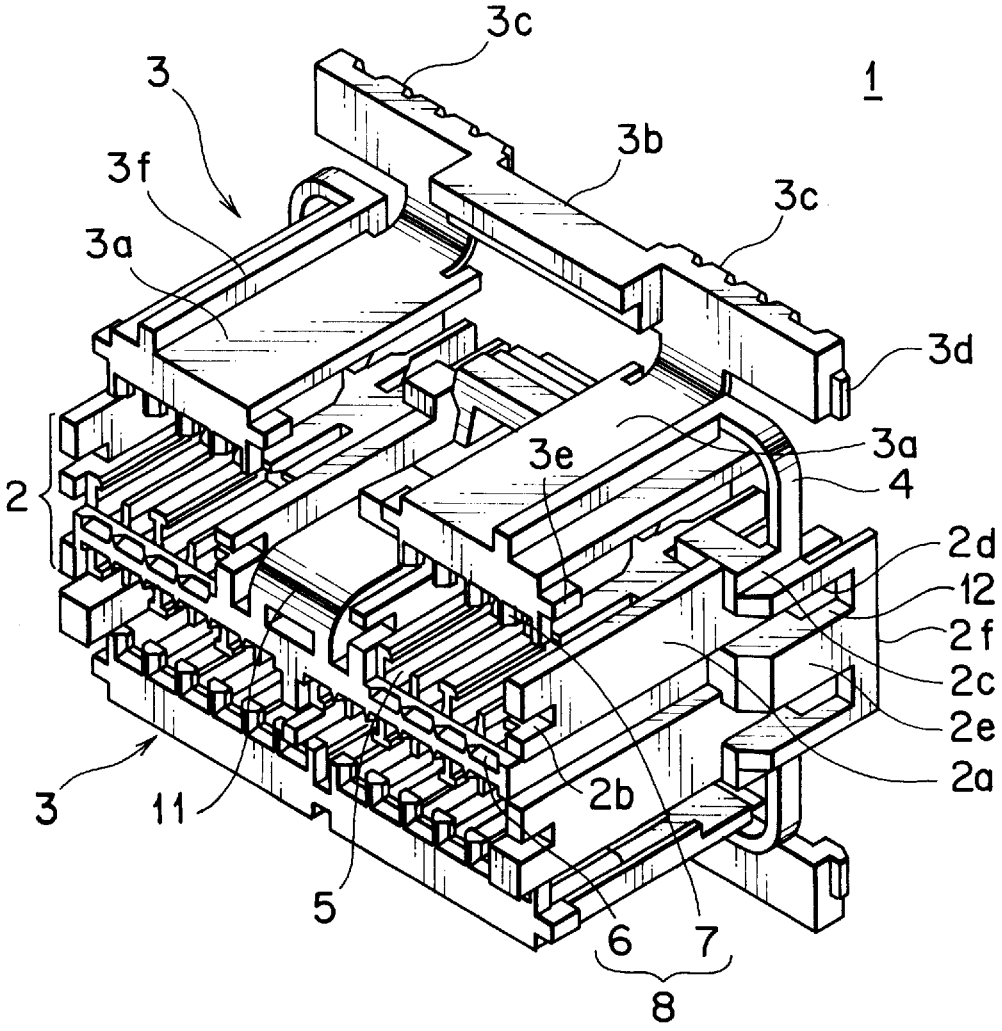
FIG. 1 is a perspective view showing an embodiment of a double-lock type connector according to the present invention.

A detailed description of preferred embodiments of the double-lock type nonnector according to the present invention is provided with reference to the drawings. FIG. 1 is a perspective view showing a double-lock type connector according to the present invention. A double-lock type connector 1 comprises a housing body 2, a rear holder 3, and a hinge 4 for connecting them each other.

The housing body 2 is made of synthetic resin and so forth, in which a terminal receiving chamber 5 capable of being received a plurality of female terminals is provided with two stages formed up and down. As shown in FIG. 4, a resilient locking piece 10 is so provided that a base end portion 10*a* is integraly formed with an internal wall of the housing body 2, a free end portion 10*b* thereof engages with locking step portion 9*a* of the terminal 9 so that the terminal 9 is locked with the housing body 2.

Furthermore, an insertion groove 2*b* for preventing projection for lift of rear holder is formed on each front end portion of the side wall or surface 2*a* of the housing body portion 2 with notched from the free end portion. When the rear holder 3 is mounted on the housing body 2, a preventing projection 3*e* for lift of rear holder is inserted into the insertion groove 2*b* for preventing projection for lift of rear holder.

A rear hoder side tapered guid portion 7 is formed at a lower portion or an upper portion of the terminal receiving chamber 5 in front of the housing body 2. A tapered guide portion 8 which is used when it causes a male terminal (not illustrated ) to insert into a terminal inserted portion 20 of the housing body 2, is so constituted that the taper portion 6 is joined together the rear holder side tapered guide portion 7 described hereinafter.

A resilient locking arm 11 is formed at center of a horizontal direction of the housing body 2 so that it causes a female connector 1 to lock with a male housing (not illustrated).

A combined portion 2*e* combining upper and lower side surface 2*a* extended in the horizontal direction, and a elongated portion 2*d* elongated at up and down of the combined portion 2*e* in the horizontal direction, on the side surface 2*a* of the housing body 2. These elongated portion 2*d* and combined portion 2*e* are joined with a joining portion 2*f* elongated in the direction of vertically. Moreover, a rear holder-guide locking groove 12 is formed between the elongated portion 2*d* and the combined portion 2*e*, when the rear holder 3 is mounted on the housing body 2, which is engaged with the regular or real locking projection 3*d* causing the rear holder 3 to fix to the housing body 2.

The rear holder 3 is provided at the upper part or the lower part of the housing body 2, and it comprises a pair of rear holder portion 3*a* shaped bilateral symmetry. These rear holder portions 3*a* are joined by joining portion 3*b*. A part of the terminal receiving chamber is formed at an inner wall of each rear holder portion 3*a*, and also in front thereof, a rear holder side tapered guide portion 7 is formed, a tapered guide portion 8 and also the housing side tapered portion 6 are so constituted that it causes the male terminal to insert into the terminal insertion portion of the female connector housing body.

Terminal locking portions 3*c* are provided at a rear portion of each rear holder portion 3*a*. The terminal locking portion 3*c* is provide in order to lock a terminal 9 doubly. As shown FIG. 4B, in the double-locking condition of the terminal 9, the terminal locking portions 3*c* come into contact with a metallic rear end portion of the terminal 9. Further, the real locking projection 3*d* is formed at a side surface of the terminal locking portion 3*c*, when it causes the rear holder 3 to mount to the housing body 2, the real locking projection 3*d* engages with the rear holder guide-locking groove 12 so that it can function as a prevention member for coming-out when the rear holder is mounted on housing body 2.

The hinge 4 joins the housing body 2 to the rear holder 3. Namely, one end of the hinge 4 is integrally formed with a projecting portion 2*c* on the side surface 2*a* of the housing body 2, and the other end thereof is integrally formed with a protuberance 3*f* formed at the outer side surface of the rear holder portion 3*a* of the rear holder 3 and also on the outer side surface thereof. The rear holder 3 is capable of being moved relatively in the direction of front and rear, and lateral direction with regard to the housing body 2 due to a resilient property of the hinge 4. Furthermore, in the embodiment, it causes the rear holder to integrally form the housing body 2 through the hinge 4, however, the rear holder 3 can be separated from the housing body 2 without using the hinge 4.

Figure 2:
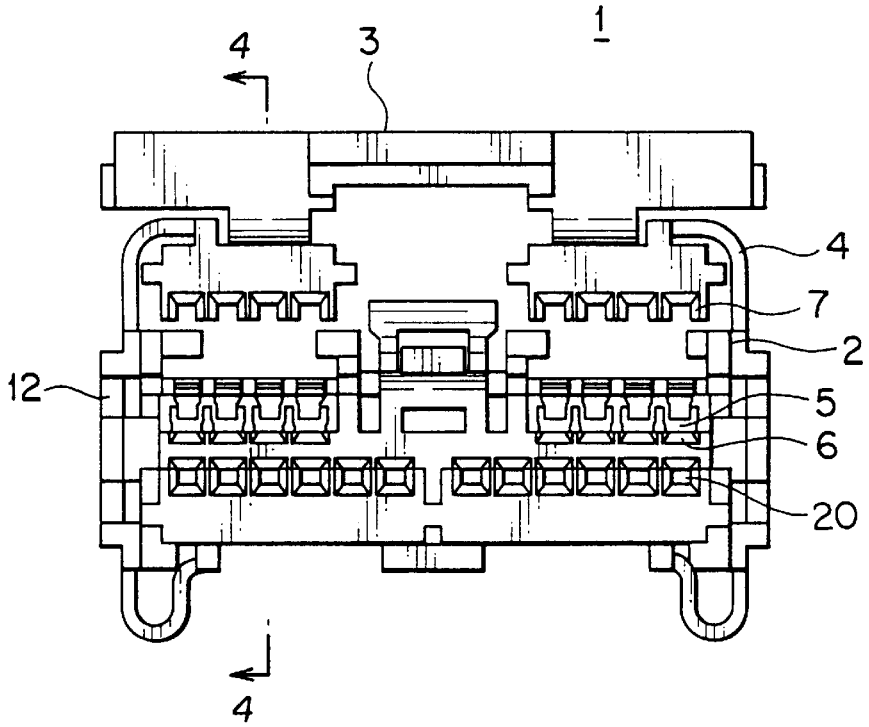
FIG. 2 is an elevation view showing the double-lock type connector of FIG. 1 in which an upper half thereof shows a previous mounted condition to the rear holder and a lower half thereof shows a mounted condition.
Figure 3:
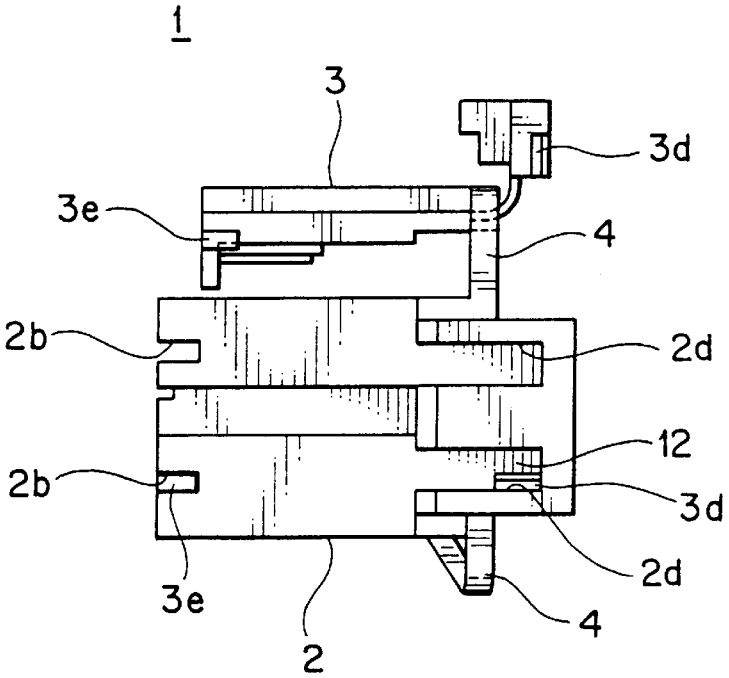
FIG. 3 is a right side view of the double-lock type connector of FIG. 2.

FIG. 2 is an elevation view of the above double-lock type connector, and FIG. 3 is a right side view of FIG. 2. upper halves of these drawings show the previous condition of mounting the rear holder 3 to the housing body 2, lower halves thereof show the condition of mounting the rear holder 3 to the housing body 2. As it is obvious from these drawings, parts 6, 7 of the guiding-tapered portion formed at the rear holder 3 and the housing body 2 respectively are joined after causing the rear holder to mount on the housing 2 so that the guiding-tapered portion 8 is formed all periphery of the terminal insertion portion 20.

Next, an operation for the double-lock type connecter having the above structure according to the present invention will be explained referring to FIGS. 4A and 4B.

Figure 4A:
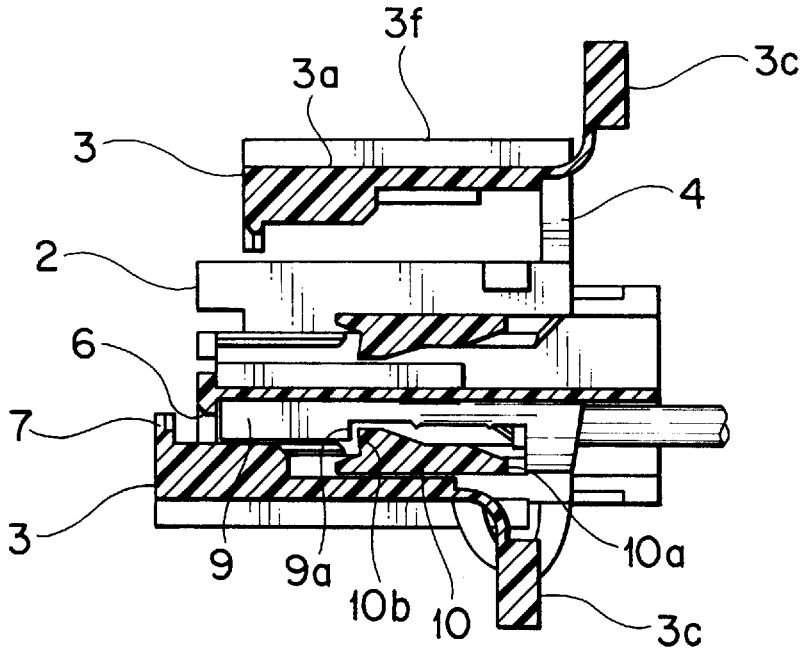

Firstly, it causes the terminal 9 to insert into the terminal receiving chamber 5 from the rear side of the housing body 2, namely from the right direction in FIG. 4A. The metallic part of the terminal 9 inserted comes into contact with the resilient locking piece 10, and then, in addition, the resilient locking piece 10 is distorted resiliently with the terminal 9 advanced. The locking step portion 9*a* passes through the engaging portion 10*b* of the resilient locking piece 10 and then the resilient locking piece 10 moves back toward the initial position, and since a front wall of the terminal receiving chamber 5 can function as a stopper, the terminal 9 is fixed to the inside of the terminal receiving chamber 5.

Next, as shown in the lower half of FIG. 4A, it causes the rear holder to push forward so that the housing body 2 can be covered by the rear holder 3. It causes the preventing projection 3*e* for lift of rear holder of the rear holder 3 to insert into the insertion groove 2*b* for preventing projection for lift of rear holder from ahead thereof, subsequently, the rear holder 3 is mounted on the housing body 2 so as to make the preventing projection 3*e* for lift of rear holder move backwards. At this time, the housing side tapered guide portion 6 formed at the housing body 2 and the rear holder tapered guide portion 7 formed at the rear holder 3 can integrally constitute the tapered guide portion 8.

Figure 4B:
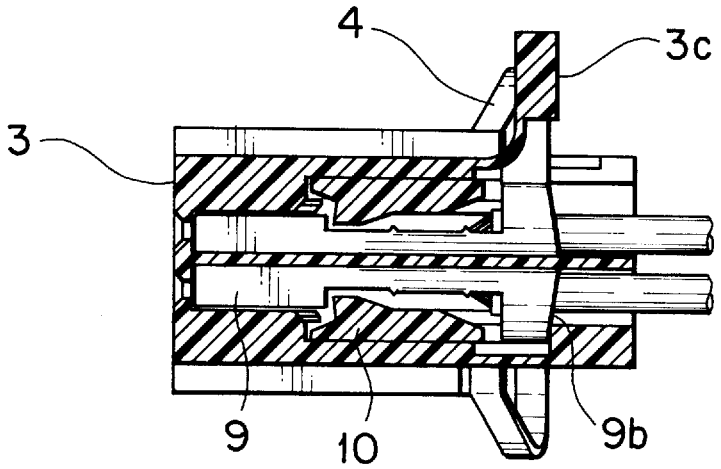
Figure 5:
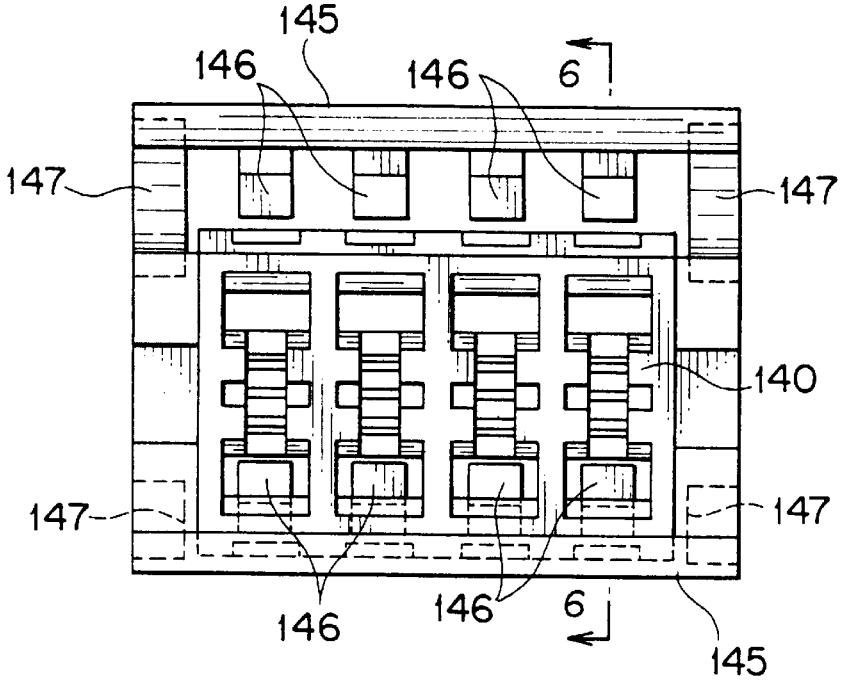
FIG. 5 PRIOR ART
FIG. 5 is an elevation view showing a conventional double-lock type connector.
Figure 6:
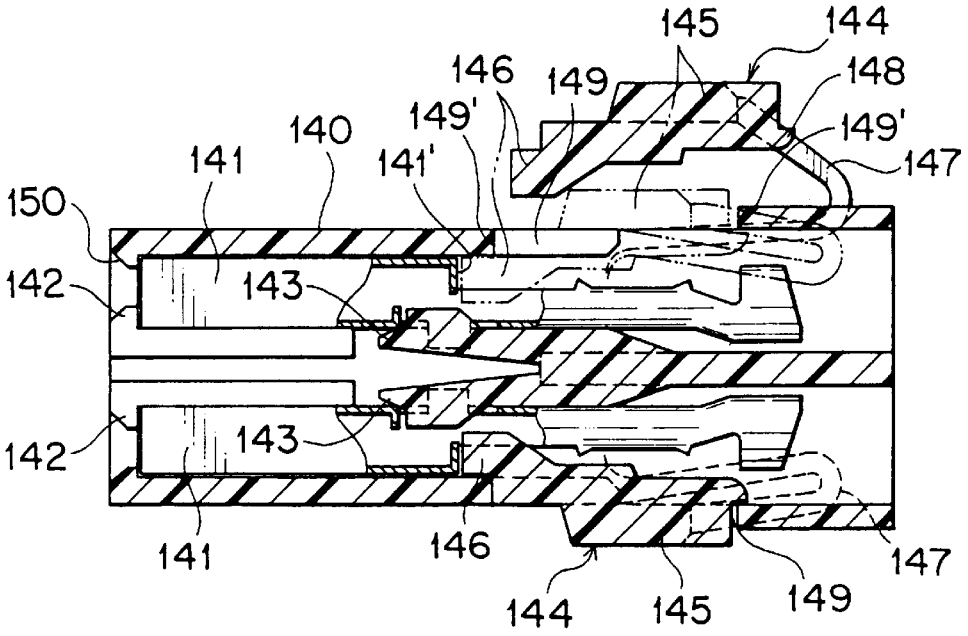
FIG. 6 PRIOR ART
FIG. 6 is a cross sectional view along the line 6—6 of FIG. 5.
Figure 7:
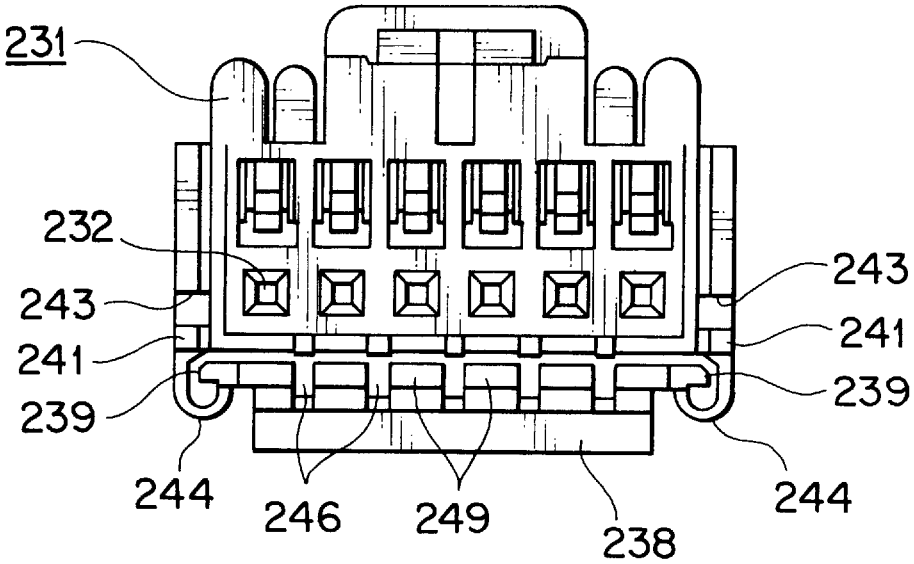
FIG. 7 PRIOR ART
FIG. 7 is an elevation view showing a conventional double-lock type connector.
Figure 8:
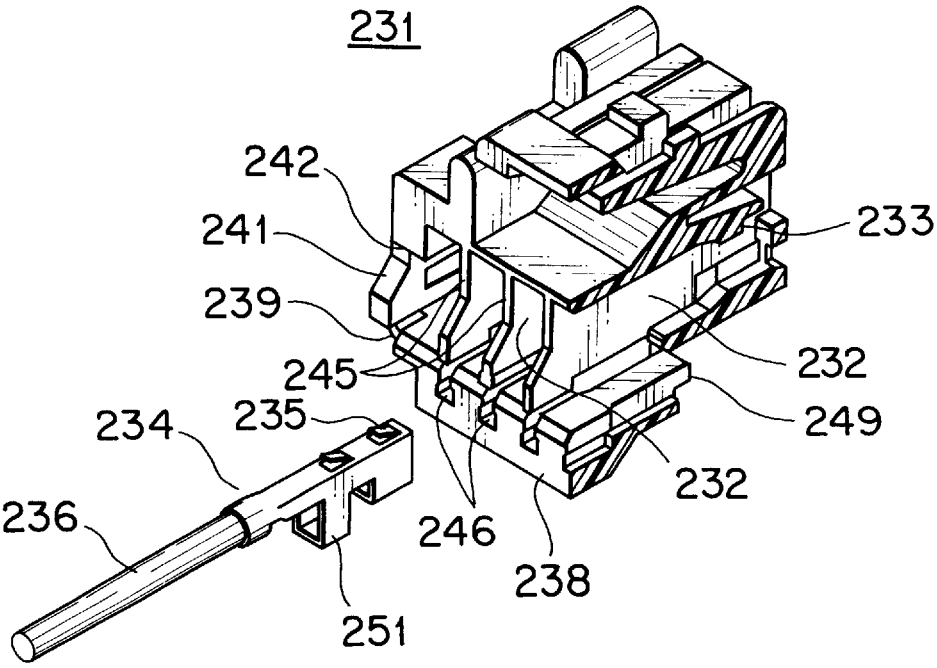
FIG. 8 PRIOR ART
FIG. 8 is a perspective view showing a part of the housing 231 of the double-lock type connector and the terminal 251.

In addition, as shown in the upper half of FIG. 4B, it causes the terminal locking portion 3*c* of the rear holder 3 to rotate clockwise a 90° turn. This would result in the condition shown in the lower half of FIG. 4B in that the terminal 9 is locked doubly. At this time, the real locking projection 3*d* formed at the side surface of the terminal locking portion 3*c* of the rear holder 3 engages with the rear holder guide-lock groove 12 formed at the side surface of the housing body 2 so that the rear holder 3 is securely locked to the housing body 2.

As described above, according to the present invention, it causes the rear holder for locking doubly of the terminal to mount on the female connector housing, subsequently it is capable of being formed the integral tapered guide portion at whole periphery of the male terminal insertion portion, for this reason, even if the tab width of the male terminal is nearly equal to the inside-blank width stamped out of the resilient locking piece, it is capable of being provided the small-sized double-lock type connector in that it can be guided the male terminal toward the terminal receiving portion of the female terminal.

Also according to the present invention, the number of parts can be diminished, and it is capable of being provided the double-lock type connector which is assembled easily.

What is claimed is:

1. A double-lock type connector comprising:

a female connector housing body having a front and a rear, a terminal insertion portion, and a terminal receiving chamber, wherein a male terminal is received in said female connector housing body after having been inserted through a front of said terminal insertion portion, and a female terminal, engaged with said male terminal, is received in said terminal receiving chamber;

a resilient locking piece, projecting from an inside wall of said terminal receiving chamber, for locking said female terminal to said inside wall of said terminal receiving chamber;

a rear holder, removably provided on said female connector housing body, for preventing movement of said female terminal toward said rear of said female connector housing body when said rear holder has been moved in a direction relative to said front and said rear of said female connector housing body and also in a vertical direction with respect to said female connector housing body from a detached position to an attached position wherein said rear holder is in contact with said female connector housing body and a terminal locking portion of said rear holder has been moved toward said female connector housing body so as to he in contact with said female terminal to doubly lock said female terminal in Said female connector housing body thereby preventing rearward movement of said female terminal in said female connector housing a housing side tapered guide portion, formed in said female connector housing body, for guiding said male terminal toward said terminal insertion portion; and a rear holder side tapered guide portion, formed on said rear holder, for guiding said male terminal toward said terminal insertion portion, wherein said housing side tapered guide portion and said rear holder side tapered guide portion form an integral tapered guide portion, said integral tapered guide portion being formed around an entire periphery of said terminal insertion portion.

2. The double-lock type connector according to claim 1, wherein said rear holder is integrally formed with said female connector housing body through said hinge.

3. The double-lock type connector according to claim 1, wherein said rear holder is separately formed from said female connector housing body.

4. The double-lock type connector according to claim 1, wherein said connector housing body is made of synthetic resin.

5. The double-lock type connector according to claim 1, further comprising rear holder lift-preventing-projection inserting grooves, said inserting grooves being formed on each front end portion of a side wall of said female connector housing body, wherein each of said grooves are notched from a free end portion of said female connector housing body.

6. The double-lock type connector according to claim 1, further comprising a resilient locking arm formed at a center of said female connector housing body in a horizontal direction of said female connector housing body so that said double-lock-type connector is locked to a male connector.

7. The double-lock type connector according to claim 1, further comprising a rear holder-guiding locking groove formed in a side surface of said female connector housing body between an elongated portion and a combined portion when said rear holder is in said attached position to be mounted on said female connector housing body, said rear holder-guiding locking groove being engaged with a real locking projection on said rear holder causing said rear holder to be fixed to said female connector housing body.

8. The double-lock connector according to claim 1, further comprising a real locking projection formed on a side surface of a terminal locking portion said real locking projection causing said rear holder to be mounted on said female connector housing body, wherein said real locking projection engages with a rear holder guiding-locking groove so as to function as a preventing member for projecting outwardly when said rear holder is mounted on said female connector housing body.

* * * * *